United States Patent [19]

Platt et al.

[11] Patent Number: 4,794,745

[45] **Date of Patent: * Jan. 3, 1989**

[54] TIER DROP GRID SYSTEM

[75] Inventors: William J. Platt, Collingdale; Paul C. Gillenwater, Glenmoore, both of Pa.

[73] Assignee: National Rolling Mills Inc., Malvern, Pa.

[ * ] Notice: The portion of the term of this patent subsequent to Nov. 22, 2005 has been disclaimed.

[21] Appl. No.: 941,805

[22] Filed: Dec. 15, 1986

[51] Int. Cl.[4] ..... E04B 5/55

[52] U.S. Cl. ..... 52/484; 52/664; 52/729

[58] Field of Search ..... 52/484, 664–668, 52/729, 488

[56] References Cited

U.S. PATENT DOCUMENTS

| | | | |
|---|---|---|---|
| D. 34,721 | 7/1901 | Davis . | |
| 1,749,648 | 3/1930 | Ray . | |
| 2,963,751 | 12/1960 | Mancini . | |
| 3,279,139 | 10/1966 | Stahlhut . | |
| 3,327,444 | 6/1967 | Downing, Jr. . | |
| 3,396,997 | 8/1968 | Adams | 52/484 |
| 3,496,690 | 2/1970 | Jahn | 52/232 |
| 3,623,290 | 11/1971 | Downing, Jr. | 52/484 X |
| 3,746,379 | 7/1973 | Sauer . | |
| 3,778,947 | 12/1973 | Sauer | 52/232 |
| 3,783,771 | 1/1974 | Hartzell et al. | 52/484 X |
| 3,846,031 | 11/1974 | Adams | 403/28 |
| 3,871,150 | 3/1975 | Murray et al. | 52/484 X |
| 3,898,782 | 8/1975 | Donato | 52/488 |
| 4,021,986 | 5/1977 | McCall et al. | 52/484 X |
| 4,034,531 | 7/1977 | Balinski | 52/484 |
| 4,108,563 | 8/1978 | Brown et al. | 403/347 |
| 4,208,851 | 6/1980 | Sauer | 52/573 |
| 4,272,937 | 6/1981 | Brugman | 52/484 X |
| 4,462,198 | 7/1984 | Sharp | 52/667 |
| 4,470,239 | 9/1984 | Sauer | 52/667 X |
| 4,484,428 | 11/1984 | Sauer | 52/484 X |
| 4,505,083 | 3/1985 | Mieyal | 52/484 X |
| 4,525,973 | 7/1985 | Vukmanic et al. | 52/667 |
| 4,542,615 | 9/1985 | McCall | 52/484 X |

FOREIGN PATENT DOCUMENTS

| | | | |
|---|---|---|---|
| 2173227 | 10/1986 | United Kingdom | 52/484 |

*Primary Examiner*—J. Karl Bell

*Attorney, Agent, or Firm*—John F. A. Earley; John F. A. Earley, III; P. Michael Walker

[57] ABSTRACT

A suspended ceiling grid member which comprises a web portion, an upper bulb extending along the top of the web portion, a pair of flanges extending outwardly from the bottom of the web portion, the flanges being adapted to support ceiling tiles, and a lower bulb extending downwardly from the flanges, whereby the lower bulb provides greater strength to the suspended ceiling grid member and also enhances the appearance thereof.

12 Claims, 3 Drawing Sheets

TIER DROP GRID SYSTEM

BACKGROUND OF THE INVENTION

1. Field of the Invention

This invention relates to improvements in a suspended ceiling grid structure adapted to support ceiling tiles or the like, and more particularly concerns improvements in the cross sectional design of the suspended ceiling grid members.

2. Description of the Prior Art

Suspended ceiling grid structures for supporting ceiling tiles are known in the art. Typically, such grid structures have a plurality of parallel main beams or runners connected together at right angles by a plurality of cross tees. The main beams and cross tees typically have an inverted T construction and include a central web or fin having a bulb at the top and a pair of oppositely disposed flanges at the bottom. An ornamental cap may be mounted on the bottom of the flanges. Ceiling tiles are supported on the flanges. Suspended ceiling grid members of this type are shown in U.S. Pat. Nos. 4,606,166 and 4,106,878.

Another design of main beams and cross tees includes a central web or fin having a bulb at the top and a pair of oppositely disposed inwardly projecting C-shaped flanges at the bottom. The C-shaped flanges create an opening or a channel opposite its point of connection with the web portions. When ceiling tiles are supported by this type of flange, the ceiling grid structure has an aesthetically pleasing shadow appearance between the panels A ceiling grid structure of this type is shown in U.S. Pat. No. 4,462,198.

Still another ceiling grid structure that has a shadow appearance between the ceiling tiles or panels is a main beam and cross tee design that includes a central web or fin having a bulb at the top and a pair of oppositely disposed outwardly projecting L-shaped flanges at the bottom. The L-shaped flanges create an opening or channel opposite its point of connection with the web portions A ceiling grid member of this type is shown in U.S. Pat. No. 4,542,615.

Prior art suspended ceiling grid structures lack flexibility in appearance. Grid members that have an inverted T construction give the grid structure a bold appearance between the ceiling tiles. Grid members that have inwardly projecting C-shaped flanges or outwardly projecting L-shaped flanges at the bottom give the grid structure a shadow or recessed appearance between the ceiling tiles These prior art grid members do not give you a choice of appearance.

SUMMARY OF THE INVENTION

Accordingly, it is an object of this invention to provide a suspended ceiling grid structure member that is adaptable for use with different types of ceiling tiles to give different appearances to the suspended ceiling grid structure without changing the grid structure members It is a further object of this invention to provide a suspended ceiling grid structure with a shadow appearance and with strengthened main beam and cross tee members It is still a further object of this invention to provide a strengthened suspended ceiling grid member that does not require a significant increase in construction material.

In accomplishing these and other objects, improvements are provided in the cross-sectional design of the main beam and cross tee members of the suspended ceiling grid structure. The main beam and cross tee members are preferably rolled from a single sheet of metal to form a top bulb, a central web or fin, a pair of oppositely disposed flanges and a bottom bulb. The oppositely disposed flanges are adapted to support ceiling tiles or the like. The appearance of the suspended ceiling grid structure depends on the type of ceiling tile selected for use with the grid structure members.

DETAILED DESCRIPTION

Figure 1:
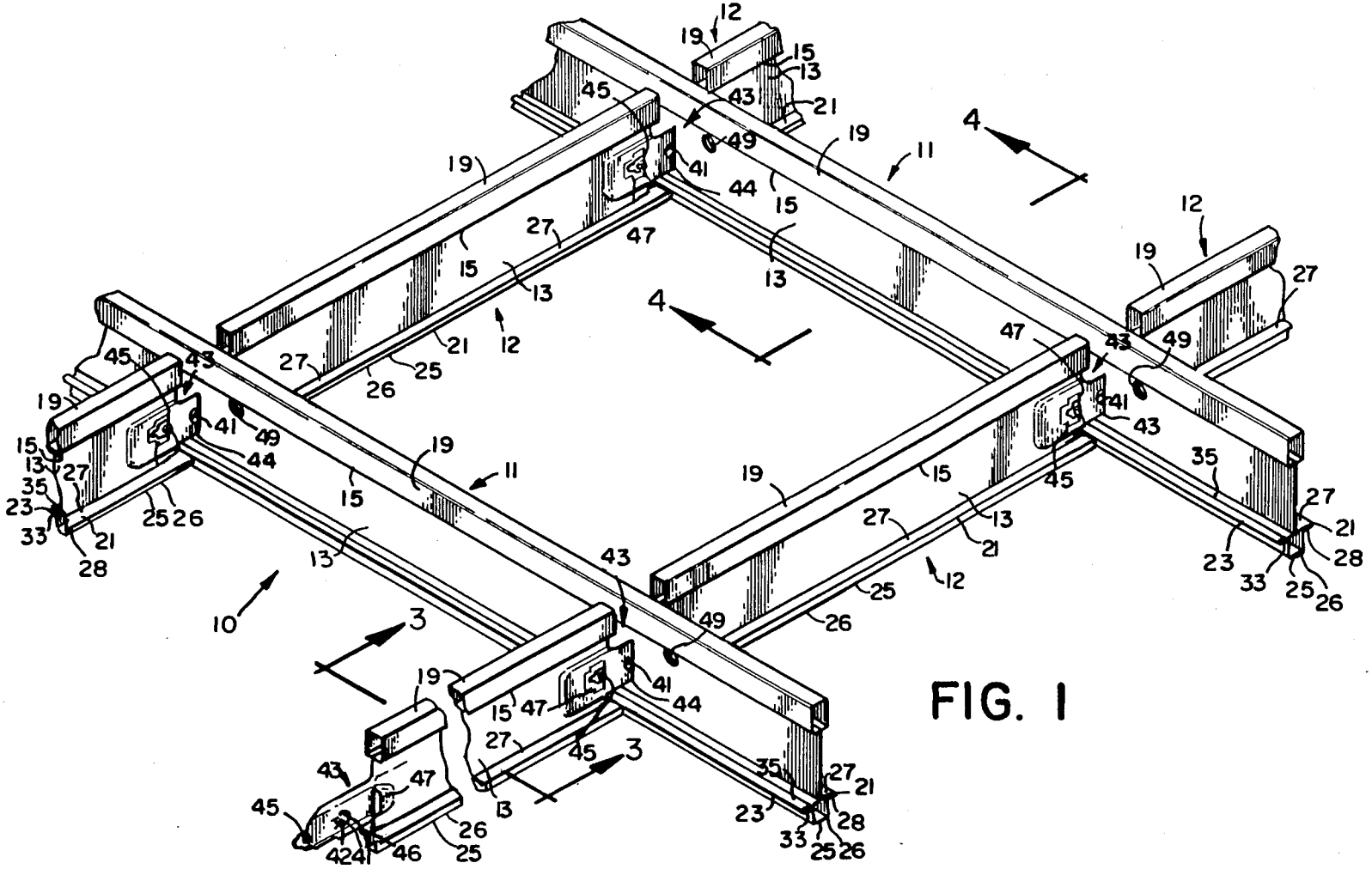
FIG. 1 is a fragmentary view in perspective of a suspended ceiling grid structure constructed in accordance with the invention.

Turning now to the drawings, there is shown a suspended ceiling grid structure 10 adapted to support ceiling tiles or the like, which comprises a plurality of main beams or runners 11 arranged in spaced-apart, substantially parallel relationship, and cross tees 12 which connect adjacent main beams 11 together The main beams 11 and cross tees 12 are roll-formed from a sheet of metal material and include a central web or fin 13 having an upper web section 15 and a lower web section 17. The central web 13 is preferably constructed of a double thickness of the sheet metal material for strength.

A top bulb or bead 19 depends from and extends along the upper web section 15 of the central web 13 The top bulb 19 is of a rectangular configuration, and is also formed from the same sheet of material as the central web 13.

A flange 21 and an oppositely disposed flange 23 extend perpendicularly outwardly from and along the lower web section 17 of the central web 13.

A bottom bulb or bead 25 extends downwardly from and along the flanges 21,23. The bottom bulb 25 is of a generally rectangular shape, and provides both greater strength to the main beams 11 and the cross tees 12 and also enhances the appearances thereof The main beams 11 and cross tees 12 are preferably roll-formed from a single sheet of metal The metal is first bent into an L shape to form leg 22 of the flange 23 and a first sidewall 29 of the central web 13. At the top of the central web 13, the metal is further bent to form the rectangular-shaped top bulb 19 and a second sidewall 31 of the central web 13.

At the bottom of the second sidewall 31, the metal sheet is bent outwardly to form the top portion 27 of flange 21. The metal is then bent inwardly, forming the bottom portion 28 of the flange 21.

After the flange 21 has been formed, the metal sheet is bent downwardly, horizontally, and then upwardly in roughly a U-shape to form bottom bulb 25. Portion 33 of the metal sheet is folded under leg 22 of flange 23, and portion 35 is folded over leg 22. The top portion 35 of the flange 23 is coplanar with top portion 27 so as to seat the ceiling tiles evenly.

Figure 2:
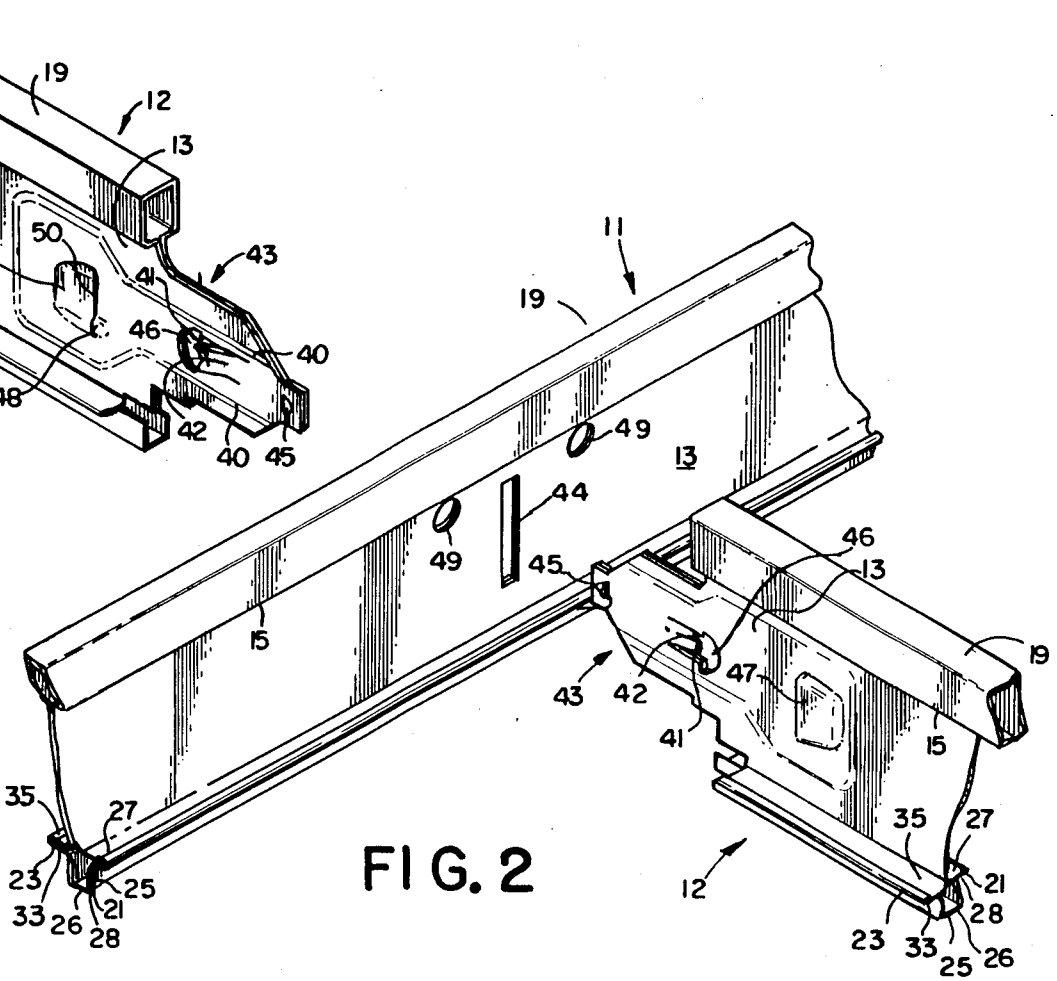
FIG. 2 is an exploded view in perspective of the end portions of opposed cross tees and the slot portion of a main beam.

As shown more particularly in FIG. 2, cross tee 12 includes a tongue 43 that is preferably offset from the center plane of the web 13 by approximately one-half the thickness of the web 13. A locking tab 41 is formed in the tongue 43 and extends laterally outwardly from the tongue 43 whereby when a cross tee 12 is connected to a main beam 11 the locking tab 41 of the tongue 43 engages the central web 13 of the main beam 11. A tab spine or crease 42 is formed in the center of locking tab 41 so that the locking tab 41 is V-shaped in cross section, with the locking tab edges extending away from, and the tab spine 42 being close to, the tongue 43. The V-shape in cross section of the locking tab 41 greatly increases the resistance of the cross tee 12 to pull-apart forces.

Opening 46 is formed axially away from the edge of the locking tab 41 whereby when a tongue 43 is inserted through a slot 44 of a main beam 11, the locking tab 41 flexes back into the cavity it left when the locking tab 41 was punched, and flexes into the opening 46. The opening 46, which is preferably D-shaped, is provided because when a tab 41 is punched through sheet metal, it is larger than the cavity it leaves. If the opening 46 were not present, the locking tab 41 could not flex back when inserted through the slot 44 of the main beam 11 because the locking tab 41 would strike the metal of the web 13.

Each cross tee 12 further includes interlocking means of such configuration that either end of a cross tee 12 may be interlocked with a similarly constructed but oppositely disposed cross tee 12. The interlocking means comprises an interlocking fingernail 45 formed in and extending laterally outwardly from the tongue 43 and in a direction opposite to the projection of the locking tab 41. The interlocking fingernail 45 is preferably formed by depressing the metal and making only a vertical cut or incision in the tongue 43.

The interlocking means further includes a fingernail interlocking pocket 47 formed in and extending laterally outwardly from the central web 13 of the cross tee 12. The fingernail interlocking pocket 47 is preferably formed by depressing the metal and making only a vertical cut or incision on the central web 13 of the cross tee 12, which creates a fingernail interlocking pocket edge 50.

The fingernail interlocking pocket 47 is offset or raised whereby a connecting tongue 43 of an interconnected cross tee 12 is not severely bent or deformed when inserted into the interlocked position.

Another feature of the interlocking means is that the bottom portion 48 of the fingernail interlocking pocket edge 50 is flared laterally outwardly in a direction opposite to the direction of the extension of the fingernail interlocking pocket 47 by an amount approximating the thickness of the interlocking fingernail 45 whereby the tongue 43 of the cross tee 12 and the tongue 43 of a similarly constructed but oppositely disposed cross tee 12 may be disengaged from the interlocked relationship by moving the interlocked cross tees 12,12 so that an interlocking fingernail 45 of one cross tee 12 passes through the interlock release pocket 48 of the opposite cross tee 12.

The cross tees 12 are also provided with stiffening ribs 40 that reinforce and greatly strengthen the ends of cross tees 12 and connecting tongues 43.

The bottom bulbs 25 of the cross tees 12 abut the bottom bulb 25 of the main beam 11. Also, the flanges 21, 23 of cross tees 12 abut the flanges 21,23 of main beam 11.

Figure 5:
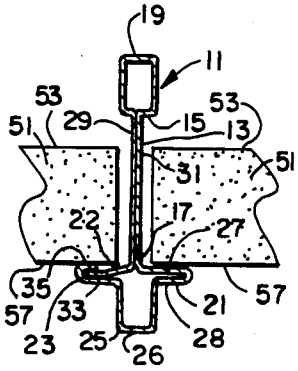
FIG. 5 is a view in cross section of a suspended ceiling grid member supporting a ceiling tile.
Figure 6:
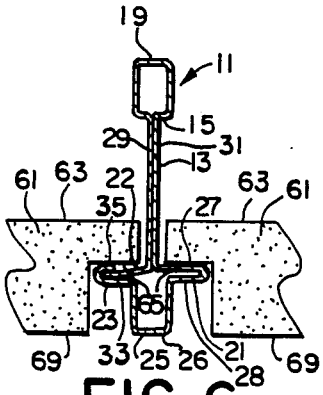
FIG. 6 is a view in cross section of a suspended ceiling grid member supporting an alternative type of ceiling tile.
Figure 7:
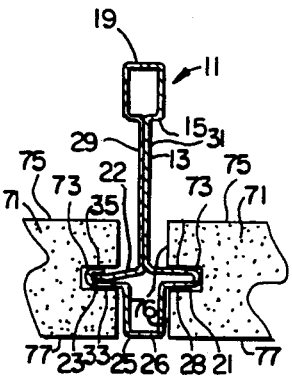
FIG. 7 is a view in cross section of a suspended ceiling grid member supporting an alternative type of ceiling tile.

A suspended ceiling grid structure 10 comprising main beams 11 and cross tees 12 is adaptable to support different types of ceiling tiles, as shown in FIGS. 5,6, and 7.

In FIG. 5, ceiling tile 51 has a square or rectangular edge portion, and the bottom edge 57 of the ceiling tile 51 rests against and contacts either the top portion 35 of the flange 23 or the top portion 27 of the flange 21 of a main beam 11 or cross tee 12 for a distance sufficient to support the tile 51. The visual effect using ceiling tile 51 is a bold look, because the bottom bulbs 25 and the flanges 21,23 of main beams 11 and cross tees 12 are fully exposed.

In FIG. 6, ceiling tiles 61 are provided with a recess around its sides and include a top surface 63, a support surface 65, and a bottom surface 69. The support surface 65 rests against and contacts flanges 21 or 23 of a main beam 11 or cross tee 12 to support the ceiling tile 61. The bottom surface 69 of the ceiling tile 61 is coplanar with the surface 26 of the bottom bulb 25. The visual effect using ceiling tile 61 is a tegular, or tile-shaped appearance, which is a softer appearance than the bold look of FIG. 5, because the bottom bulb 25 is shadowed between the tiles 61. The shadow effect is created because the flanges 21,23 are recessed into the ceiling tile 61.

In FIG. 7, ceiling tiles 71 are provided with a groove 73 around their perimeters and include a top surface 75, side edges 76, and a bottom surface 77. Grooves 73 are adapted to receive flanges 21,23 of a main beam 11 or a cross tee 12. The bottom surface 77 of the ceiling tile 71 is coplanar with the face 26 of the bottom bulb 25. The visual effect using ceiling tile 71 is a semi-concealed look. The only portion of a main beam 11 or a cross tee 12 that is visible is the face 26 of the bottom bulb 25

Figure 8:
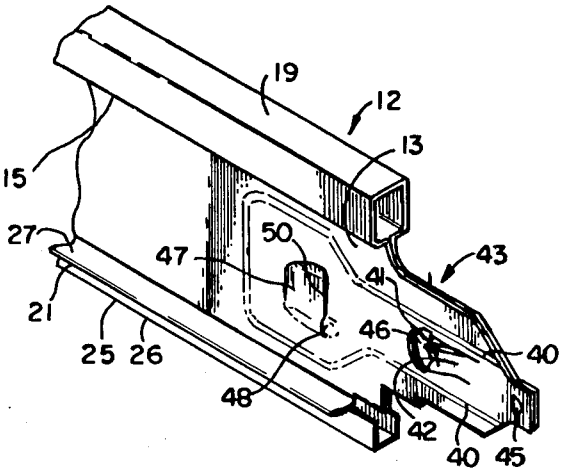
FIG. 8 is a view in section of an alternative embodiment of a grid member constructed in accordance with the invention.
Figure 8:
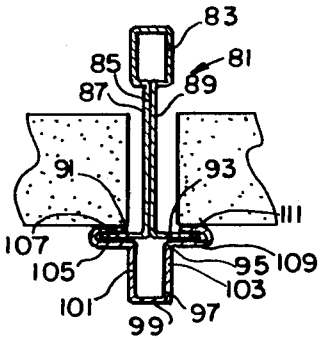
Figure 3:
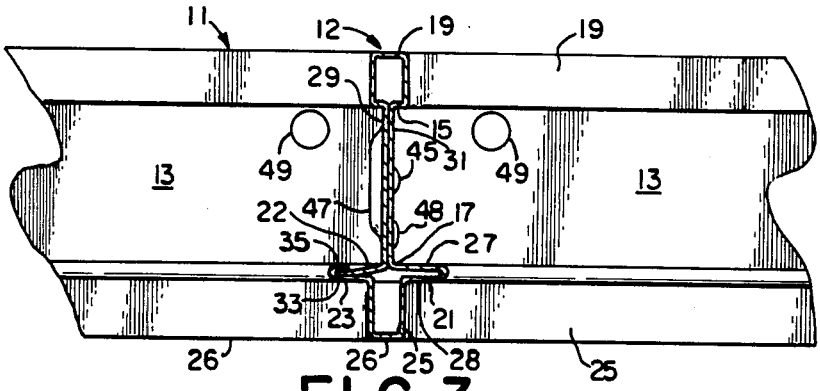
FIG. 3 is a view in section as indicated by the lines and arrows 3—3 which appear in FIG. 1.
Figure 4:
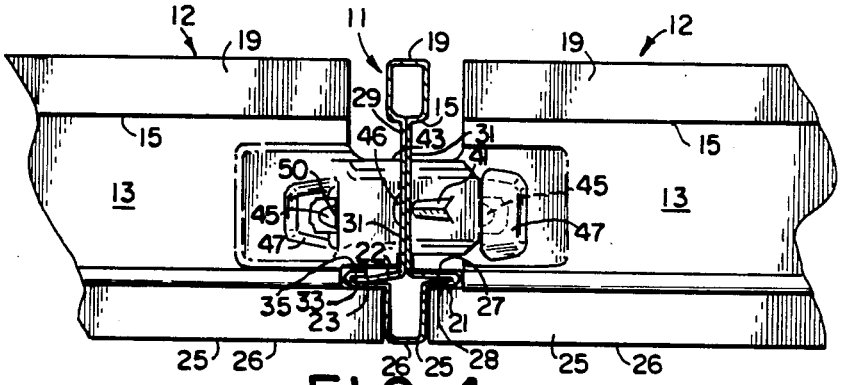
FIG. 4 is a view in section as indicated by the lines and arrows 4—4 which appear in FIG. 1.

Turning now to the embodiment disclosed in FIG. 8, there is shown a suspended ceiling grid member 81 which comprises a top bulb or bead 83 which is rectangular in shape, a web 85 extending downwardly from top bulb 83, and including two web portions 87,89, and a pair of flanges, 91,93 extending outwardly from the bottom of the web 85. A separate cap 95 is attached to flanges 91,93 and is supported thereon. Cap 95 comprises a lower bulb or bead 97 with a bottom surface 99, two upstanding sidewalls 101,103, a flange 105 extending outwardly from the top of sidewall 101 and a lip 107 which is bent over the top of flange 91 so as to grasp the flange 91 securely between lip 107 and flange 105.

Similarly, a flange 109 extends outwardly from the top of sidewall 103 and is bent back so that a lip 111 overlaps flange 93 and grips flange 93 securely between lip 111 and flange 109.

Ceiling grid member 81 may be used in the same way and with the same tiles as shown in FIGS. 5–7.

We claim:

1. A roll formed suspended ceiling grid member, comprising an inverted T-grid member having a web portion roll formed from a sheet of metal, a hollow rolled metal sheet upper bulb extending along the top of the web portion, means for supporting ceiling tiles and strengthening the ceiling grid member comprising a pair of metal sheet flanges extending outwardly from each side of the web portion at the bottom of the web portion for supporting ceiling tiles and for strengthening the grid member and adding to its appearance, each flange including a top leg portion and a bottom leg portion, the top leg portion being flat, the bottom leg portion of the flanges including a single hollow elongate lower bulb extending downwardly all along the length of the flanges and open to view so as to be seen by a viewer from below, the bottom leg portion of the flanges also including a flat portion extending outwardly from each side of the lower bulb at the top of the lower bulb, said flat portions of the bottom leg portions of the flanges being flattened against the top leg portions of the flanges, the lower bulb being centrally disposed with respect to the web portion and the upper bulb with both flanges extending outwardly from the top of the lower bulb so that the lower bulb does not prevent the flanges from being fully inserted into a slot in the side of a ceiling tile to support the ceiling tile, whereby the lower bulb provides greater strength to the suspended ceiling grid member and also enhances the appearance thereof and provides different types of ceiling tiles with different appearances including a bold look, a shadowy look, or a semi-concealed look and the lower bulb and flanges are interchangeable with ceiling tile having a square edge portion, a recessed bottom edge, or an edge portion with a slot that receives the flanges.

2. The suspended ceiling grid member of claim 1, said member made of a single sheet of metal with a first edge of the metal sheet forming an edge of a top leg portion of one of the flanges, and a second edge of the metal sheet overlapping the first edge.

3. The suspended ceiling grid member of claim 1, said member being made of a sheet of metal with one edge of the metal sheet forming an edge of one of the flanges and another edge of the metal sheet forming an edge of the other flange, and the lower bulb comprises a cap having a single, hollow, closed lower bulb formed therein with arms extending outwardly from the lower bulb forming the bottom leg portions of the flanges, and lips extending from the arms which overlap the edges of the flanges to connect the cap to the flanges.

4. The suspended ceiling grid member of claim 1, including a number of said grid members being arranged in a suspended ceiling grid which is supporting ceiling tiles, said ceiling tiles having rectangular edge portions with the bottom of the tiles resting against the top leg portions of the flanges for fully exposing the bottom bulb and bottom flanges to create a bold look.

5. The suspended ceiling grid member of claim 1, a number of said grid members being arranged in a suspended ceiling grid which is supported ceiling tiles, said ceiling tiles having a top and bottom surface and a recesses around its perimeter which defines a horizontal support surface, said support surface resting on the top leg portions of the flanges to withdraw the bottom flanges into the ceiling tile recess and create a shadow effect by shadowing the bottom bulb between the tiles.

6. The suspended ceiling grid member of claim 1, a number of said grid members being arranged in a suspended ceiling grid which is supporting ceiling tiles, including a ceiling tile having a top and bottom surface with a horizontal slot around its perimeter in the sidewalls of the tiles, said slot being adapted to receive the flanges of the grid members to hide the flanges and create a semi-concealed look with the only visible portion of the grid members being the bottom face of the bottom bulb.

7. A cross tee comprising a web portion, an upper bulb extending along the top of the web portion, a pair of flanges extending outwardly from the bottom of the web portion for supporting ceiling tiles, each flange including a top leg portion and a bottom leg portion, the bottom leg portion including a single, U-shaped lower bulb extending downwardly, the lower bulb being centrally disposed with respect to the web portion and the upper bulb, whereby the lower bulb provides greater strength to the suspended ceiling grid member and also enhances the appearance thereof and provides different types of ceiling tile with different appearances including a bold look, or a shadowy look, or a semi-concealed look, a connecting tongue extending from an end of the web, the tongue being offset from the center of the web by approximately one-half the thickness of the web, locking means formed in the tongue for locking said cross tee to a slot provided in a main beam to which the cross tee is connected in the ceiling grid, an interlocking means formed in the tongue for interlocking the cross tee with interlocking means of a similarly constructed but oppositely disposed cross tee when the cross tees are inserted into the slot from opposite directions, and an interlock release means formed in the tongue for disengaging the tongues of two similarly constructed but oppositely disposed interlocked cross tees from the interlocked relationship.

8. The cross tee of claim 7, wherein the locking means includes a locking tab formed in and extending laterally outwardly from the tongue thereby creating a locking surface facing away from the end of said tongue, and an opening positioned in the tongue at the end of the locking tab.

9. The cross tee of claim 7, wherein the interlocking means comprises an interlocking fingernail formed in and extending laterally outwardly from the tongue in a direction opposite to the projection of the locking tab thereby creating an interlocking surface facing away from the end of the tongue, and a fingernail locking pocket formed in and extending laterally outwardly from the cross tee web in the same direction as the interlocking fingernail thereby creating a fingernail locking edge.

10. A cross tee comprising a web portion, an upper bulb extending along the top of the web portion, a pair of flanges extending outwardly from the bottom of the web portion for supporting ceiling tiles, each flange including a top leg portion and a bottom leg portion, the bottom leg portion including a single, U-shaped lower bulb extending downwardly, the lower bulb being centrally disposed with respect to the web portion and the upper bulb, whereby the lower bulb provides greater strength to the suspended ceiling grid member and also enhances the appearance thereof and provides different types of ceiling tiles with different appearances including a bold look, or a shadowy look, or a semi-concealed look, a connecting tongue extending from an end of the web, the tongue being offset from the center of the web by approximately one-half the thickness of the web, locking means formed in the tongue for locking said cross tee to a slot provided in a main beam to which the cross tee is connected in the ceiling grid, an interlocking means formed in the tongue for interlocking the cross tee with interlocking means of a similarly constructed but oppositely disposed cross tee when the cross tees are inserted into the slot from opposite directions, and an interlock release means for disengaging the tongues of two similarly constructed but oppositely disposed interlocked cross tees from the interlocked relationship, wherein the interlock release means comprises an interlock release pocket formed in the bottom portion of the fingernail locking edge by a laterally outward flare of the bottom portion, the flare being approximately the thickness of the interlocking fingernail, and whereby the tongue of the cross tee and the tongue of a similarly constructed but oppositely disposed interlocked cross tee may be disengaged from the interlocked relationship by moving the interlocked cross tees relative to one another so that an interlocking fingernail passes through the interlock release pocket of the opposite cross tee.

11. A cross tee comprising a web portion an upper bulb extending along the top of the web portion, a pair of flanges extending outwardly from the bottom of the web portion for supporting ceiling tiles, each flange including a top leg portion and a bottom leg portion, the bottom leg portion including a single, U-shaped lower bulb extending downwardly, the lower bulb being centrally disposed with respect to the web portion and the upper bulb, whereby the lower bulb provides greater strength to the suspended ceiling grid member and also enhances the appearance thereof and provides different types of ceiling tiles with different appearances including a bold look, or a shadowy look, or a semi-concealed look, a connecting tongue extending from an end of the web, the tongue being offset from the center of the web by approximately one-half the thickness of the web, locking means formed in the tongue for locking said cross tee to a slot provided in a main beam to which the cross tee is connected in the ceiling grid, an interlocking means formed in the tongue for interlocking the cross tee with interlocking means of a similarly constructed but oppositely disposed cross tee when the cross tees are inserted into the slot from opposite directions, and an interlock release means for disengaging the tongues of two similarly constructed but oppositely disposed interlocked cross tees from the interlocked relationship, wherein the locking means includes a locking tab formed in and extending laterally outwardly from the tongue thereby creating a locking surface facing away from the end of said tongue, and an opening positioned in the tongue at the end of the locking tab, wherein the interlocking means comprises an interlocking fingernail formed from and extending laterally outwardly from the tongue in a direction opposite to the projection of the locking tab thereby creating an interlocking surface facing away from the end of the tongue, and a fingernail locking pocket formed in and extending laterally outwardly from the cross tee web in the same direction as the interlocking fingernail thereby creating a fingernail locking edge, wherein the interlock release means comprises an interlock release pocket formed in the bottom portion of the fingernail locking edge by a laterally outward flare of the bottom portion, the flare being approximately the thickness of the interlocking fingernail, whereby the tongue of the cross tee and the tongue of a similarly constructed but oppositely disposed interlocked cross tee may be disengaged from the interlocked relationship by moving the interlocked cross tees relative to one another so that an interlocking fingernail passes through the interlock release pocket of the opposite cross tee.

12. A roll formed suspended ceiling grid member, comprising a web which is roll formed from a sheet of metal, a hollow rolled metal sheet top bulb extending along the top of the web, first and second metal sheet flanges extending oppositely and outwardly from the bottom of the web for supporting ceiling tiles, a single hollow closed bottom bulb extending downwardly below the flanges, the bottom bulb being centrally disposed with respect to the web and with respect to the top bulb with both flanges extending outwardly from the bottom bulb so that the bottom bulb does not prevent the flanges from being fully inserted into a slot in the side of a ceiling tile to support the ceiling tile, the bottom bulb providing greater strength to the suspended ceiling grid member and also enhancing the appearance of the ceiling by providing different ceiling appearances including a bold look, a shadowy look, or a semi-concealed look with the lower bulb and flanges being interchangeable with ceiling tiles having a square edge portion for the bold look, or a recessed bottom edge for the shadowy look, or an edge portion with a slot that receives the flanges for the semi-concealed look, said ceiling grid member being made of a single sheet of metal with a first edge and a second edge, a top leg portion of the first flange extending inwardly from the first edge with the sheet then bending upwardly to form a first web sidewall, then bending from the top of the first web sidewall to the top of the second form a second web sidewall which abuts the first web sidewall, then bending outwardly to form a top leg portion of the second flange and bending inwardly to form a bottom leg portion of the second flange, then bending downwardly and horizontally and upwardly to form the single hollow closed bottom bulb, then bending outwardly to form a bottom leg portion of the first flange, and then bending inwardly to form a sheet portion which overlaps the first edge of the metal sheet and the top leg portion of the first flange.

* * * * *